US007278557B2

(12) United States Patent
Rackwitz

(10) Patent No.: US 7,278,557 B2
(45) Date of Patent: Oct. 9, 2007

(54) PRESSURE CONTAINER FOR VISCOUS SUBSTANCES

(75) Inventor: Ingo Rackwitz, Steinau (DE)

(73) Assignee: Nestec S.A., Vevey (CH)

( * ) Notice: Subject to any disclaimer, the term of this patent is extended or adjusted under 35 U.S.C. 154(b) by 95 days.

(21) Appl. No.: 10/502,086

(22) PCT Filed: Feb. 6, 2003

(86) PCT No.: PCT/EP03/01183

§ 371 (c)(1),
(2), (4) Date: Jul. 22, 2004

(87) PCT Pub. No.: WO03/068632

PCT Pub. Date: Aug. 21, 2003

(65) Prior Publication Data

US 2005/0145654 A1 Jul. 7, 2005

(30) Foreign Application Priority Data

Feb. 13, 2002 (DE) ..... 102 06 077

(51) Int. Cl.
*B65D 83/00* (2006.01)

(52) U.S. Cl. ..... 222/402.15; 222/402.17; 222/518; 137/625.33

(58) Field of Classification Search ..... 222/402.24, 222/402.21, 402.2, 402.15, 153.12, 578, 222/476, 453, 462.2, 402.17, 509, 506, 518, 222/514; 137/114, 630.22, 628, 629, 625.33; 251/353, 349

See application file for complete search history.

(56) References Cited

U.S. PATENT DOCUMENTS

| | | | | | |
|---|---|---|---|---|---|
| 2,702,657 | A | * | 2/1955 | Davis | 222/359 |
| 2,892,572 | A | * | 6/1959 | Fredette et al. | 222/153.06 |
| 3,231,153 | A | | 1/1966 | Green et al. | |
| 3,572,386 | A | * | 3/1971 | Sherwin | 137/630.22 |
| 3,768,475 | A | * | 10/1973 | Osborne | 604/249 |
| 3,987,942 | A | * | 10/1976 | Morane et al. | 222/402.15 |
| 5,040,705 | A | * | 8/1991 | Snell | 222/402.15 |
| 5,752,631 | A | | 5/1998 | Yabuno et al. | |
| 6,062,430 | A | * | 5/2000 | Fuchs | 222/105 |

(Continued)

FOREIGN PATENT DOCUMENTS

EP 1 167 842 A2 1/2002

(Continued)

*Primary Examiner*—Kevin Shaver
*Assistant Examiner*—Stephanie E. Tyler
(74) *Attorney, Agent, or Firm*—Bell, Boyd & Lloyd LLP

(57) ABSTRACT

A pressure container is used for receiving viscous substances and has an outlet valve (14) which can be displaced between a closed position and an open position. A movable valve element (18) can be moved in the direction toward the interior of the container for unblocking an opening cross section. Since, on the one hand, a large opening cross section is desired and, on the other hand, it is necessary to overcome a very high initial resistance because of particles penetrating into the interior of the container, it is proposed to provide at least two opening cross sections which can be unblocked in sequence by actuating the valve. By means of this an initial small actuating force is achieved along with a still large opening cross section when the valve (14) is completely opened.

22 Claims, 2 Drawing Sheets

Figure 1:
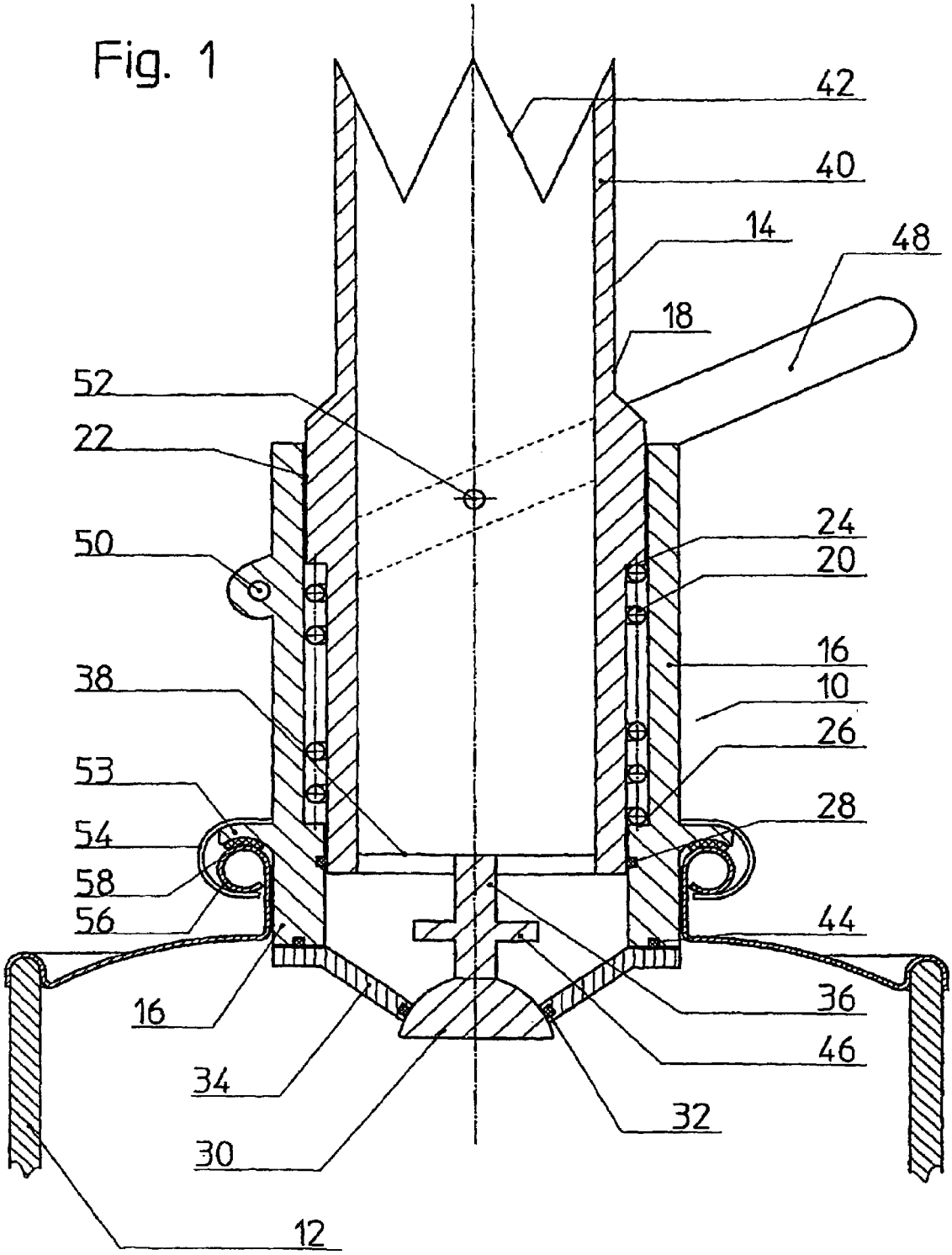

U.S. PATENT DOCUMENTS 6,321,951 B1 * 11/2001 Frutin ..... 222/389
6,340,103 B1 * 1/2002 Scheindel et al. ..... 222/402.15
6,474,510 B2 * 11/2002 Frutin ..... 222/153.11
6,685,064 B2 2/2004 Frutin
6,799,701 B2 * 10/2004 Weiperth ..... 222/158
6,820,777 B2 * 11/2004 Frutin ..... 222/402.15

FOREIGN PATENT DOCUMENTS

WO WO 01/49585 A1 * 12/2001

* cited by examiner 42
40
14
48
18
52
22
24
50
20
16
38
10
26
53
28
54
58
56
44
16
36
46
34
32
30
12

PRESSURE CONTAINER FOR VISCOUS SUBSTANCES

The present invention relates to a pressure container for receiving viscous substances. The pressure container comprises an outlet nozzle which can be displaced between a closed position and an open position. A movable engagement of the nozzle can be moved in the direction toward the interior of the container for unblocking an opening cross section.

A particular problem in connection with viscous substances, which are intended to be stored in handy pressure containers similar to known aerosol spray cans, consists in that a relatively large opening cross section must be provided in the open state of the outlet valve in order to achieve a satisfactory dispensing of the substance after the valve has been actuated. On the other hand, because of the system pressure of, for example, 10 bar, and the viscosity of the substance the problem arises, that the valve element for unblocking the opening cross section then must have a correspondingly large surface, so that the force for actuating the outlet valve is increased in an impractical manner. These problems are aggravated in connection with refrigerated pressure containers and the formation of ice caused by this, which can increase the required opening force still further.

Alternatively, a rotary valve is already known from EP 1 167 842, wherein the penetration of a portion of the valve element into the interior of the container in the course of the movement into the opened position is prevented. Here difficulties arise in the area of the seal, since it is necessary to put the sealing material under a defined pressure for achieving a permanent sealing effect, wherein the volume of the sealing material can change because of swelling caused by the substance stored in the container. Because of this the seal can either become damaged, or the actuating forces can increase to a great extent, so that the valve can become stuck. Further obvious requirements are a permanent gas tightness, and the meeting of regulations, for example in connection with laws regulating food, when storing foodstuffs in the pressure container.

It is the object of the present invention to create a pressure container for receiving viscous substances also in the deep-frozen state, whose outlet valve permanently functions dependably.

In accordance with the invention this object is attained in that at least two opening cross sections are provided for a pressure container of the type described at the outset, wherein initially a first opening cross section, which preferably is defined by a first sealing element and a first closing element, can be unblocked by actuating the valve, and thereafter at least one further opening cross section, which is preferably defined by a further sealing element and a further closing element.

The pressure container in accordance with the invention offers the advantage that initially only a narrow cross section is unblocked by means of correspondingly small actuation forces, i.e. only a small volume is displaced by the valve element penetrating into the container interior. After unblocking the first cross section, the viscous material can already flow into the outlet at a comparatively small throughput, so that a certain pressure equalization is provided in the area of the sealing locations, and furthermore the structure of the substance is loosened because of the starting outflow movement, so that the second opening cross section can also be unblocked with a comparatively small actuating force by a continued actuation of the valve element, so that thereafter the substance can flow through the large total cross section. In this way the actuating forces for opening the valve are accordingly reduced on the one hand and, on the other hand the opening cross section required for the outflow of a defined volume per unit of time is yet made possible.

The closing process takes place analogously in the reversed manner, wherein for one the closing movement is aided by the interior pressure in the container, and on the other hand a restoring spring for the valve element can also be provided.

An embodiment of the invention is particularly preferred, wherein the opening cross section which first opens when actuating the valve element is narrower than the at least one further opening cross section. Besides a conceivable successive unblocking of several opening cross sections of identical or similar size, it is also possible by means of the previously mentioned pressure equalization and the starting flow of the viscous substance to provide a correspondingly increased second, or further opening cross section in order to have a larger opening cross section for releasing the substance available as quickly as possible.

With the valve open, the opening cross section can for example be in the shape of an annular gap, wherein preferably in the area of at least one opening cross section, the closing element, which is movable by the annularly embodied sealing element for unblocking the opening cross section, can be substantially lifted axially in respect to the sealing element. Such a solution offers the advantage that the seals are not stressed by sliding movement in the area of their sealing faces, but only by pressure caused by the closing element coming into contact with them. This means that the selection of the material for the sealing element is substantially less critical, because possibly occurring swellings of a particular material are only disadvantageous for the sealing effect to a small degree and are without influence on the actuating forces. Wear on the sealing faces by repeated opening processes need hardly be feared.

Basically the sealing elements can be provided on one or both parts, which are moved in respect to each other in the area of an opening cross section. For example, the closing element, i.e. the moved part itself, can support the sealing element, or can be embodied as a sealing element by coating. In view of the viscous substances, it is useful as a rule that the sealing element has a cross-sectional shape with a flat annular contact face, or a definite sealing contour for the closing element, since linear-shaped seals possibly will not meet the requirement of a permanent gas tightness, because residues from the substance can collect between the sealing element and the closing element.

An embodiment, wherein the opening cross sections are arranged concentrically in relation to each other, is furthermore particularly practical.

The closing element of the first opening cross section is preferably arranged directly at the end of the movable valve element facing the container interior. In a preferred further development, the valve element can be embodied to be hollow and constitute the outlet opening, or nozzle, for the substance stored in the container. Such a valve element can be made in one piece and particularly cost-effectively of plastic, for example. For performing the axial movements of the connected first closing element, the valve element can be axially movably guided in a valve housing, which is connected in a pressure-tight manner with a housing of the pressure container, or it can be rotatably seated in the valve housing by means of a threaded connection. In both cases the already mentioned restoring springs can be provided in a suitable embodiment. Examples of such spring elements are conventional standard springs, or also elements made of rubber or resilient plastic materials. The clearing of the opening cross section then takes place by axially pushing the valve element in, or by twisting the valve element in the screw thread in relation to the valve housing.

With an axially movable valve element, an actuating element which is connected by means of a gear with the movable valve element can be useful. By means of this it is possible to further reduce the actuating forces wherein, in a particularly preferred embodiment, the actuating element is embodied as a lever, which is hinged to the valve element and to the valve housing.

A structurally particularly simple construction is achieved with a further preferred embodiment of the invention in that the sealing element of the first opening cross section is arranged on the closing element of the second sealing location.

With this embodiment the closing element of the second opening cross section constitutes a movable intermediate element which, in a further preferred embodiment, can be moved along by an engaging piece provided on the valve element for clearing the second opening cross section after the first opening cross section has been cleared. In this way it is possible with just a few components to construct a functionally dependable delivery valve.

The design of the engaging piece in a star shape with three or more arms is useful, wherein the second closing element has a central opening through which the valve element projects with its first closing element. The engaging piece is of course designed to be larger than the central opening and, after a defined opening travel of the valve element, rests against the second closing element and takes it along into a position in which the second opening cross section is unblocked.

An embodiment of the second closing element as a disk-shaped, cone-shaped or plate-shaped ring is particularly preferred, wherein the first sealing element is arranged in the area of the central opening. Such a design of the second closing element is very space-saving, wherein the first sealing location is defined by the first opening cross section in the area of the central opening of the second closing element, and the second sealing location by the opening cross section at the outer edge of the second closing element. A guidance device can be provided, which axially guides the second closing element and/or secures it against tilting in order to prevent a change in the relative positions of the sealing elements in respect to the closing elements, which could interfere with the sealing effect.

In a further preferred embodiment of the invention it is provided that the valve housing is made of plastic and that a hold-down device, which is crimped to an annular flange of the valve housing and an upper end of the container, is provided for the pressure-tight connection with the container. The use of the hold-down device makes it possible to connect the plastic body of the valve housing in a pressure-tight manner with the container which, as a rule is made of sheet metal, or with its upper end, the so-called top. The seal ring is preferably seated between the upper end of the top and the underside of the annular flange made of plastic, wherein it is particularly preferred to employ a seal ring designed as an annular disk which, in the initial stage prior to being fastened on the container, projects radially past the annular flange of the valve housing. It has been shown that by means of this a particularly good sealing effect is achieved, in particular if, as a result of the flanging, the seal ring comes directly between the hold-down device and the sheet metal part of the container.

Figure 2:
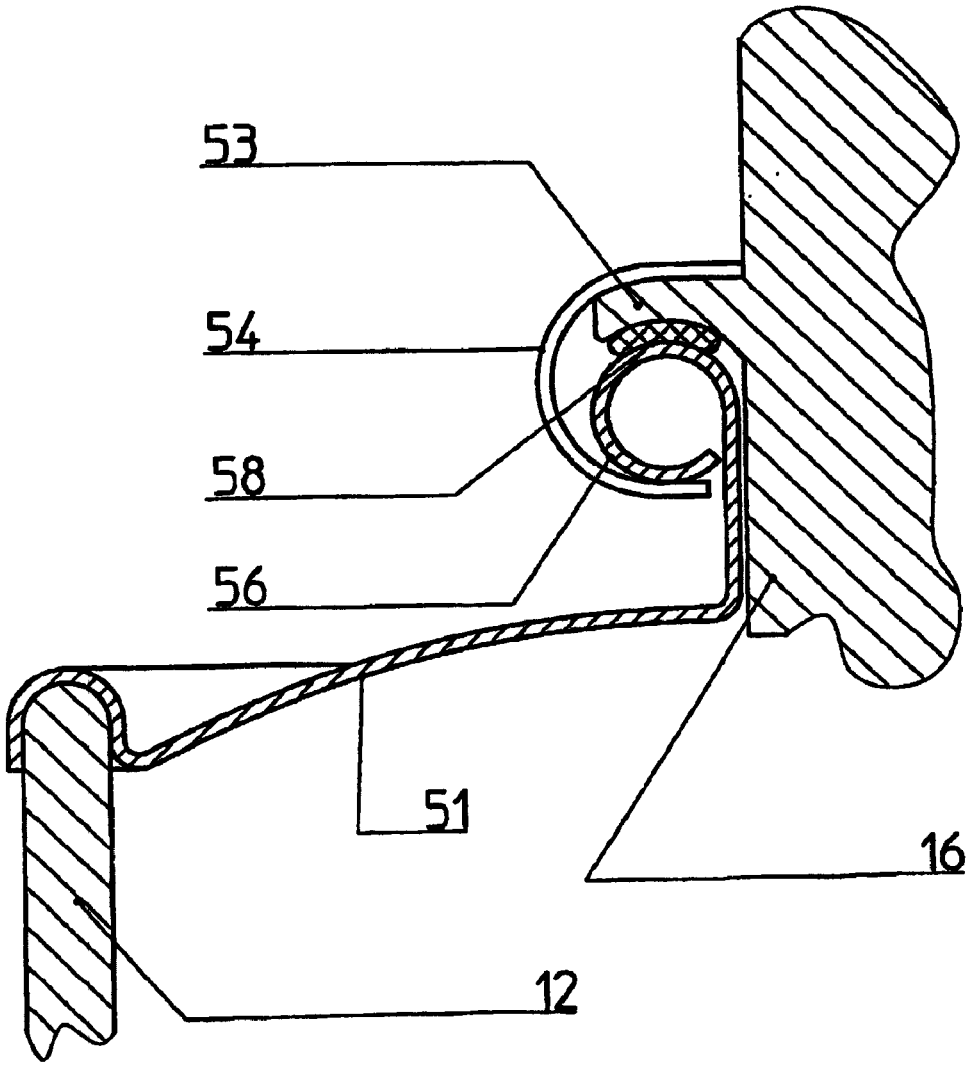

An exemplary embodiment of the invention will be addressed in greater detail in what follows by means of the attached drawings. Shown are in:

FIG. 1, a longitudinal section through a pressure container in the valve area, FIG. 2, a detailed plan view of the transition area between the valve and the container.

A longitudinal section through a pressure container 10, which is intended for receiving a viscous substance under pressure, in particular deep-frozen substances, for example ice cream, is shown in FIG. 1. The wall 12 of the container can be made of sheet metal or aluminum, and an outlet valve 14 is arranged in a pressure-tight manner in an opening in the wall 12, which will be covered in greater detail later in connection with FIG. 2.

The outlet valve 14 has a valve housing 16, which is connected in a pressure-tight manner with the container wall 12 and in which a valve element is guided, movable against the force of a restoring spring 20. To this end the valve housing 16 has an inner bore 22, whose diameter essentially corresponds to the outer diameter of the hollow-cylindrically embodied valve element 18. The restoring spring 20 is arranged between a shoulder 24 on the outer circumference of the valve element 18 and a step 26 in the inner bore 22 of the valve housing 16. A seal ring 28 in the base area of the inner bore 22 seals the space between the valve element 18 and the valve housing 16 against the penetration by the viscous substance, wherein no substantial pressure force is expected in this area.

A piston-like first closing element 30 is formed on the end of the valve element 18 facing the container interior and, together with a first sealing element 32 arranged on an intermediate element, or on the second closing element 34, forms a first sealing location. By means of an axial movement of the piston 30 in relation to the intermediate element 34 a relatively small opening cross section in the form of an annular gap can be unblocked, which will be discussed in greater detail later. The piston-shaped first closing element 30 is rigidly connected with the wall 40 of the valve element 38 via a tappet 36 with an axial orientation and radial strips 36 with spaces provided on their ends. The spaces between the radial strips permit the passage of material through the hollow valve element 18 constituting a nozzle, wherein the free end 42 of the valve element can be embodied in the shape of teeth.

The intermediate element 34 has a disk-like annular shape and simultaneously provides the function of a second closing element 34 which, acting together with a sealing element 44 provided at the front of the valve housing 16 towards the housing interior, constitutes a second sealing location wherein, with an axial movement of the second closing element 34, a second opening cross section in the shape of an annular gap can be unblocked, which is considerably larger than the first opening cross section in the area of the first sealing location. The taking along of the second closing element 34 is performed with the aid of a star-shaped engaging piece 46, wherein the circumference of its strips is greater than the inner diameter of the bore of the disk-like annularly-shaped second closing element 34, so that the latter can be taken along by the star-shaped strips of the engaging piece when the valve element 28 is axially displaced. The spaces between the strips of the engaging element 46 permit the passage of the material flowing out through the first opening cross section.

The cross sections of each of the annularly-shaped sealing elements 32, 44 in the area of the two sealing locations are such that a flat contact between the respective closing elements 30, 34 results in order to achieve as permanent as possible a pressure-tight seal, even if residues from the substance stored in the container 10 collect between the sealing element and the closing element.

An actuating lever 48 is provided for actuating the outlet valve 14, which is hinged on one side on the valve housing 16 at a hinge point 50, and on the other side on the valve element 18 at a second hinge point 52. The gearing caused by this reduces the actuating forces required for the opening movement of the valve element 18.

The actuating process takes place in such a way that, when the actuating lever 48 is pressed down, the valve element 18 is displaced in the direction of the container interior, while the restoring spring 20 is further prestressed. In the process the inclined oriented circumferential surface of the piston-like conical first closing element 30 is lifted off the sealing element 32, which is seated at the edge of an inner bore of the second closing element 34. Since the first closing element 30 has only a very small front face, the resistance during the downward push is relatively small wherein, besides the inner pressure in the container, which as a rule is approximately 10 bar, the viscosity of the substance, and in particular also the formation of ice in connection with deep-frozen substances, exerts a considerably higher resistance to the movement of the valve elements as would be the case with normal aerosols.

The unblocking of the annular gap-shaped first opening cross section because of the lifting of the first closing element 30 off the first sealing element 32 provides a certain pressure equalization on both sides of the second closing element 34, and the structure of the stored substance, particularly in the deep-frozen state, is loosened because of the start of the flow movement through the first opening cross section. However, because of the quite small cross-sectional surface in the area of the first sealing location, the exiting volume flow is very small. With the continued pressing-down of the actuating lever 48, the engaging piece 46 comes to rest against the second closing element 34 and takes it axially along in the course of further downward pressure. As already mentioned, because of the already occurred pressure equalization and the start of the flow movement, the actuating force required for this is considerably less than if the valve element 18 were rigidly connected with the second closing element 34, and no opening cross section had previously already been unblocked.

As soon as the valve element 18 has reached its depressed end position, because of the pressure existing there the viscous material can flow out of the container interior through the first annular gap-shaped opening cross section in the area of the first sealing location, and through the larger, second annular gap-shaped opening cross section in the area of the second sealing location, so that a desired volume flow with the inflow of the material into the entire nozzle area in the valve element 18 results.

After releasing the actuating lever 48, the valve element 18 is displaced by the action of the restoring spring 20 back in the direction of its closed initial position, wherein the closing process is also aided by the system pressure.

Only the sealing elements 32, 44 in the area of the sealing locations must be embodied to be pressure-tight in order to be able to withstand the system pressure permanently, while the sealing ring 28 between the valve housing 16 and the valve element 18 can be embodied as a simple O-ring.

Various alterations of the represented embodiment are of course conceivable. For example, the valve housing 18 can also be movably guided by means of a screw thread in the valve housing 16, in which case an actuating device causes the valve element 18 to rotate, and the lead of the screw thread provides the gearing in order to overcome the initial resistance when lifting the first closing element 30 off the first sealing element 32. With such an embodiment, a torsion spring can be arranged for restoring the valve element 18. It is also conceivable to provide the sealing element 32 not directly on the second closing element 34, but on the first closing element 30. In that case the second closing element 34 provides only a contact face in the area of the first opening cross section for the sealing element moved together with the first closing element 30. The second sealing element 34 can also have the form of an annular disk or of a simple cone, wherein massively constructed closing elements 34 of greater thickness are conceivable, which in that case could be manufactured as a molded plastic article, for example. The second closing element 34 can also support the second sealing element 44 of the second opening cross section, wherein in that case it is only necessary to provide a corresponding suitable contact surface on the valve housing. Also conceivable is a closing element, for example, which is completely or partially coated with a sealing material and constitutes sealing elements for both opening cross sections. It is furthermore conceivable to provide guide elements in the area of the first closing element or at the front of the valve housing 16, which can provide a secure axial guidance of the second closing element 34 and/or security against tilting of the second closing element 34 in order to assure an exact resting of the closing elements against the sealing elements.

A detailed view of the area in which the valve housing 16 is connected with the upper portion 50 of the container 12, the so-called top is represented in FIG. 2. The valve housing 16 has a circular flange 52, whose outer end is embodied to be slightly curved downward. A hold-down device 54, which is seated on the circumferential surface of the valve housing 16, is crimped to the annular flange 52 and an upper bent end 56 of the top 50, wherein a disk-shaped sealing ring 58 located between the end 56 and the underside of the annular flange 52 has been jammed in such a way that it also fills the gap between the end 56 and the hold-down device 54 itself. In this way a pressure-tight connection is provided between the valve housing 16 made of plastic and the top 50 made of sheet metal which, by means of its lower radial outer end represented in FIG. 2, is connected pressure-tight in a known manner with a wall of the container 12.

In the initial state, i.e. prior to the pressure-tight mounting of the valve in the opening of the container, the hold-down 54 is seated with its substantially L-shaped cross section on the valve housing 16, and the sealing ring 58 on the underside of the flange 52 is also arranged on the valve housing 16. A detent in the area of the valve housing 16 can provide that in the initial state the hold-down device 54 is captively maintained on the valve housing 16.

The invention claimed is:

1. A pressure container for receiving viscous substances, the pressure container comprising an outlet nozzle which can be displaced between a closed position and an open position, a first closing element and a second closing element so constructed and arranged to provide sealing connections with the outlet nozzle, and a movable engagement end of the nozzle movable in the direction toward the interior of the container for unblocking a first opening cross section blocked by the first closing element and a second opening cross section blocked by the second closing element, wherein by actuating the nozzle, the first opening cross section is unblocked by displacing the first closing element with the movable engagement end of the nozzle, and thereafter the second opening cross section is unblocked by displacing the second closing element with the movable engagement end of the nozzle.

2. The pressure container in accordance with claim 1, characterized in that the first opening cross section which is first unblocked when the nozzle is actuated is smaller than the second opening cross section.

3. The pressure container in accordance with claim 1, characterized in that in the nozzle open position, at least one opening cross section has the shape of an annular gap.

4. The pressure container in accordance with claim 1, characterized in that the first opening cross section is defined by a first sealing element and said first closing element, and the second opening cross section is defined by a second sealing element and said second closing element.

5. The pressure container in accordance with claim 3, characterized in that the closing element which, for unblocking the opening cross section can be moved relative to the annularly embodied sealing element, can be lifted off essentially axially in relation to the sealing element in the area of at least one opening cross section.

6. The pressure container in accordance with claim 5, characterized in that the sealing element has a cross-sectional shape with a flat annular contact face or a defined sealing contour regarding the associated closing element.

7. The pressure container in accordance with claim 3, characterized in that the opening cross sections are arranged concentrically in respect to each other.

8. The pressure container in accordance with claim 1, characterized in that the closing element of the first opening cross section is arranged on the end of the engagement end of the nozzle facing the inside of the container.

9. The pressure container in accordance with claim 1, characterized in that the sealing element of the first opening cross section is arranged on the closing element of the second opening cross section.

10. The pressure container in accordance with claim 1, characterized in that an engaging piece is provided on the engagement end of the nozzle, which moves along the second closing element for unblocking the second opening cross section after the first opening cross section has been unblocked.

11. The pressure container in accordance with claim 10, characterized in that the engaging piece is embodied to be star-shaped and has three or more arms, and the second closing element has a central opening.

12. The pressure container in accordance with claim 11, characterized in that the second closing element is embodied as a disk-shaped, cone-shaped or plate-shaped ring, wherein the first sealing element is arranged around the central opening on the side of the closing element facing the inside of the container.

13. The pressure container in accordance with claim 12, characterized in that a guide device is provided, which axially guides the second closing element and/or secures it against tilting.

14. The pressure container in accordance with claim 1, characterized in that the engagement end of the nozzle is embodied to be hollow and constitutes the outlet opening for the substance stored in the container.

15. The pressure container in accordance with claim 1, characterized in that the engagement end of the nozzle is movably guided in a nozzle housing, which is connected in a pressure-tight manner with a housing of the pressure containers.

16. The pressure container in accordance with claim 15, characterized in that a restoring spring prestresses the engagement end of the nozzle in the direction of a closed position.

17. The pressure container in accordance with claim 1, characterized in that an actuating element is provided, which is connected via a gearing with the movable engagement end of the nozzle.

18. The pressure container in accordance with claim 17, characterized in that the actuating element is embodied as a lever, which is connected with the engagement end of the nozzle and the nozzle housing by means of hinge points.

19. The pressure container in accordance with claim 1, characterized in that the engagement end of the nozzle is rotatably seated in the nozzle housing by means of a screw thread, and that a torsion spring is provided as the restoring spring.

20. The pressure container in accordance with claim 15, characterized in that the nozzle housing is made of plastic and that a hold-down device is provided for the pressure-tight connection with the container and is crimped around an annular flange of the nozzle housing and an upper end of the container.

21. The pressure container in accordance with claim 20, characterized in that a seal ring is provided between the upper end of the container and the underside of the annular flange.

22. The pressure container in accordance with claim 21, characterized in that the seal ring is embodied as an annular disk which, in the initial state prior to fastening on the container, protrudes radially past the annular flange of the nozzle housing.

* * * * *